US012650265B2

(12) United States Patent
Zhu et al.

(10) Patent No.: US 12,650,265 B2
(45) Date of Patent: Jun. 9, 2026

(54) COLLECTOR ASSEMBLY AND HEAT EXCHANGER WITH SIMPLIFIED STRUCTURE

(71) Applicant: SANHUA HOLDING GROUP CO., LTD., Shaoxing City (CN)

(72) Inventors: Kunjun Zhu, Shaoxing City (CN); Jiong Li, Shaoxing City (CN)

(73) Assignee: SANHUA HOLDING GROUP CO., LTD., Shaoxing City (CN)

( * ) Notice: Subject to any disclaimer, the term of this patent is extended or adjusted under 35 U.S.C. 154(b) by 439 days.

(21) Appl. No.: 18/112,440

(22) Filed: Feb. 21, 2023

(65) Prior Publication Data

US 2023/0266065 A1 Aug. 24, 2023

(30) Foreign Application Priority Data

Feb. 23, 2022 (CN) ..... 202210169993.X
Feb. 23, 2022 (CN) ..... 202210171150.3

(51) Int. Cl.
*F28D 1/053* (2006.01)
*F28F 9/02* (2006.01)
*F01P 11/02* (2006.01)

(52) U.S. Cl.
CPC ..... *F28D 1/05316* (2013.01); *F28D 1/05366* (2013.01); *F28F 9/0224* (2013.01); *F01P 2011/0233* (2013.01); *F01P 11/0285* (2013.01)

(58) Field of Classification Search
CPC ..... F28D 1/05316; F28D 1/05366; F28F 9/0224; F28F 9/0236; F01P 2011/0233; F01P 11/0285
USPC ..... 165/47
See application file for complete search history.

(56) References Cited

U.S. PATENT DOCUMENTS 4,366,858 A * 1/1983 Moranne ..... F28F 9/0231 165/104.32
6,525,267 B1 * 2/2003 Worley ..... F16J 15/064 174/370
2006/0042568 A1 * 3/2006 Hada ..... F01P 11/028 123/41.44
2010/0012296 A1 1/2010 Cox
2018/0117498 A1 * 5/2018 Johnston ..... F28F 9/02
2019/0376752 A1 * 12/2019 Mazzoni ..... F28F 9/0224
2022/0146161 A1 * 5/2022 Hamadate ..... B23K 1/19
(Continued)

FOREIGN PATENT DOCUMENTS

CN 201588681 U 9/2010
CN 102052872 A 5/2011
(Continued)

*Primary Examiner* — Joel M Attey
(74) *Attorney, Agent, or Firm* — Cheng-Ju Chiang

(57) ABSTRACT

A collector assembly includes a first collector and a pipe. The first collector includes an outlet pipe. A pipe chamber of the outlet pipe is in communication with an inner chamber of the first collector. The pipe includes an inlet end portion and an outlet end portion. The inlet end portion is located in the first collector. The outlet end portion is at least partially located in the outlet pipe. An inner chamber of the pipe is in communication with the pipe chamber of the outlet pipe and the inner chamber of the first collector. At least part of the outlet end portion is located in the pipe chamber of the outlet pipe. A heat exchanger having the collector assembly is also disclosed.

5 Claims, 13 Drawing Sheets

(56) References Cited

U.S. PATENT DOCUMENTS

| | | | | |
|---|---|---|---|---|
| 2023/0168039 | A1* | 6/2023 | Han | F28F 9/0214 165/175 |
| 2023/0366630 | A1* | 11/2023 | Han | F28F 9/0226 |

FOREIGN PATENT DOCUMENTS

| | | | |
|---|---|---|---|
| CN | 201874663 | U | 6/2011 |
| CN | 202141248 | U | 2/2012 |
| CN | 202195054 | U | 4/2012 |
| CN | 106523791 | A | 3/2017 |
| CN | 206429297 | U | 8/2017 |
| CN | 207378144 | U | 5/2018 |
| CN | 108826804 | A | 11/2018 |
| CN | 110332828 | A | 10/2019 |
| CN | 210178906 | U | 3/2020 |
| CN | 212082135 | U | 12/2020 |
| CN | 212804213 | U | 3/2021 |
| CN | 113324424 | A | 8/2021 |
| DE | 4232376 | C2 | 9/1997 |
| DE | 10213064 | A1 | 11/2004 |
| DE | 102005005043 | A1 | 8/2006 |
| EP | 0270433 | A1 | 6/1988 |
| EP | 1754014 | B1 | 7/2011 |
| FR | 2913477 | A1 | 9/2008 |
| JP | 6959156 | B2 | 11/2021 |
| WO | 2009/058395 | A2 | 5/2009 |

* cited by examiner

COLLECTOR ASSEMBLY AND HEAT EXCHANGER WITH SIMPLIFIED STRUCTURE

CROSS-REFERENCE TO RELATED APPLICATIONS

This patent application claims priority of a Chinese Patent Application No. 202210169993.X, filed on Feb. 23, 2022 and titled "COLLECTOR ASSEMBLY AND HEAT EXCHANGER", and a Chinese Patent Application No. 202210171150.3, filed on Feb. 23, 2022 and titled "HEAT EXCHANGER", the entire content of which is incorporated herein by reference.

TECHNICAL FIELD

The present disclosure relates to a technical field of heat exchange, in particular to a collector assembly and a heat exchanger.

BACKGROUND

Heat exchangers are widely used in heat exchange systems (such as air conditioning systems). The heat exchanger can be used for exchanging heat between a heat exchange medium and the external air, or between two heat exchange mediums.

Air exists inside the heat exchanger. It is difficult for such air to exit the heat exchanger with a flow of the heat exchange medium. The presence of air will occupy part of an inner chamber of the heat exchanger, reducing the inner chamber of the heat exchanger. In the related art, in addition to an outlet pipe for the heat exchange medium to flow out, the heat exchanger is also provided with an air discharge pipe. A pipe chamber of the air discharge pipe communicates with the inner chamber of a collector of the heat exchanger. The air discharge pipe is connected with a pipeline, the air is sent to the pipeline through the air discharge pipe, and then sent to other parts along the pipeline, so that the air is discharged out of the heat exchanger. The air discharge pipe and the collector form a collector assembly. The collector assembly of the heat exchanger needs to be provided with an opening for installing the air discharge pipe. Moreover, the connection between the air discharge pipe and the collector, the connection between the pipeline and the air discharge pipe, and the connection between the pipeline and other components all need to consider sealing, which makes the structure of the collector assembly and the heat exchanger more complicated.

A first collector of the heat exchanger includes a first chamber and a second chamber. The first chamber and the second chamber are isolated from each other in the first collector and do not communicate with each other. The first collector includes a first piece, a second piece and a first sealing member. The first piece includes a barrier between the first chamber and the second chamber. The barrier and the second piece abut against the first sealing member, respectively, to achieve a sealing effect. In the related art, under a free state, a cross section of the first sealing member located between the barrier and the second piece is circular. The resilience force of the first sealing member after being compressed will be relatively large, which will cause the barrier or the second piece to deform, thereby affecting the sealing effect.

SUMMARY

In view of the above-mentioned problems in the related art, an object of the present disclosure is to provide a collector assembly and a heat exchanger with a relatively simple structure.

Another object of the present disclosure is to provide a heat exchanger with better reliability.

In order to achieve the above object, the present disclosure adopts the following technical solution: a collector assembly, including: a first collector including an outlet pipe, a pipe chamber of the outlet pipe being in communication with an inner chamber of the first collector; and a pipe including an inlet end portion and an outlet end portion; the inlet end portion and the outlet end portion being respectively located at two opposite sides in a length direction of the first collector; the inlet end portion being located in the inner chamber of the first collector; the outlet end portion being at least partially located in the pipe chamber of the outlet pipe; an inner chamber of the pipe being in communication with the pipe chamber of the outlet pipe; the inner chamber of the pipe being in communication with the inner chamber of the first collector.

In the present disclosure, part of the pipe is located in the inner chamber of the first collector, and another part of the pipe is located in the pipe chamber of the outlet pipe. The inner chamber of the pipe communicates with the inner chamber of the first collector and the pipe chamber of the outlet pipe. When the collector assembly is in an application state and there is air in the first collector, the air in the inner chamber of the first collector is guided through the pipe to the pipe chamber of the outlet pipe, and the air flows out of the collector assembly together with a heat exchange medium flowing out of the outlet pipe. An outlet of the pipe communicates with the pipe chamber of the outlet pipe. As a result, the structure of the collector assembly is simplified.

In order to achieve the above object, the present disclosure also adopts the following technical solution: a heat exchanger, including: a heat exchange tube and the above-mentioned collector assembly. The heat exchange tube is sealingly connected with the first collector. An inner chamber of the heat exchange tube communicates with the inner chamber of the first collector.

In the present disclosure, when the heat exchanger is in a working state and there is air in the first collector, the air in the inner chamber of the first collector is guided to the pipe chamber of the outlet pipe through the pipe. The air flows out of the heat exchanger together with the heat exchange medium flowing out of the outlet pipe. The outlet of the pipe communicates with the pipe chamber that shares the outlet with the outlet pipe. As a result, the structure of the heat exchanger is simplified.

In order to achieve the above object, the present disclosure also adopts the following technical solution: a heat exchanger, including: a first collector defining a first chamber and a second chamber; wherein the first collector includes a first piece, a second piece and a first sealing member; the first piece is fixed to the second piece; the first piece includes a spacer portion between the first chamber and the second chamber; the first sealing member includes a first segment which is located between the spacer portion and the second piece; both the spacer portion and the second piece abut against the first segment; wherein the first segment includes a main body portion, a concave portion and at least two convex ribs; the convex ribs protrude from the main body portion in a direction away from the main body portion; an inner chamber of the concave portion is located between two adjacent convex ribs; the spacer portion or the second piece abuts against the convex ribs; and the concave portion is closer to the main body portion than the convex rib located adjacent to the concave portion.

In the present disclosure, the first segment between the spacer portion and the second piece is provided with the convex ribs and the concave portion. The convex ribs protrude from the main body portion to the direction away from the main body portion. The concave portion is located between two adjacent convex ribs. The spacer portion or the second piece abuts against the convex ribs. As a result, the resilience force of the first segment is reduced. It improves a phenomenon in the related art that the spacer portion or the second piece is deformed due to the large resilience force of the first piece after being compressed, and improves the reliability of the heat exchanger.

DETAILED DESCRIPTION

Figure 1:
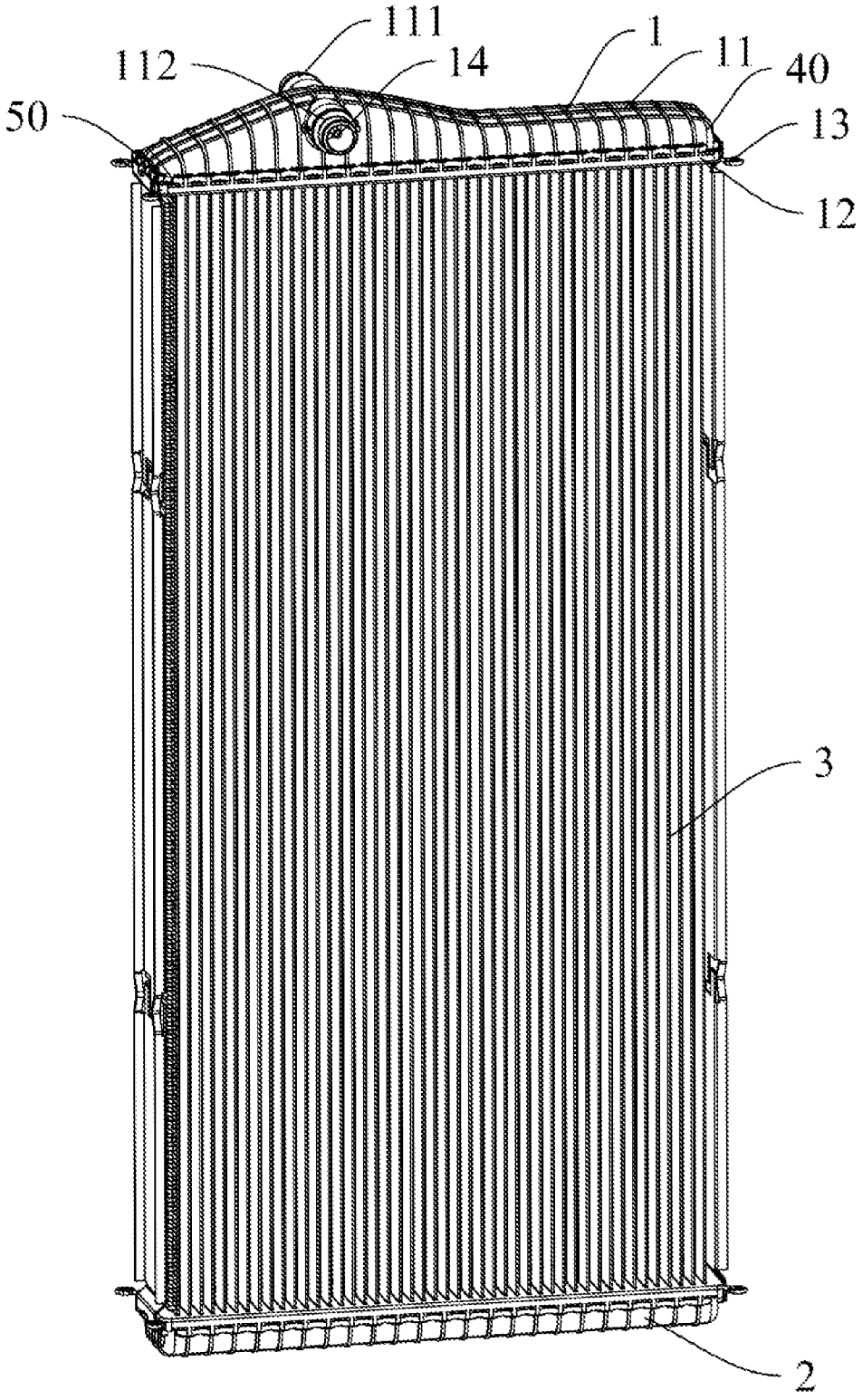
FIG. 1 is a schematic structural view of a heat exchanger in accordance with an embodiment of the present disclosure.

The exemplary embodiments will be described in detail here, and examples thereof are shown in the drawings. When the following description refers to the drawings, unless otherwise indicated, the same numbers in different drawings indicate the same or similar elements. The implementation embodiments described in the following exemplary embodiments do not represent all implementation embodiments consistent with the present disclosure. On the contrary, they are merely examples of devices and methods consistent with some aspects of the present disclosure as detailed in the appended claims.

The terms used in the present disclosure are only for the purpose of describing specific embodiments, and are not intended to limit the present disclosure. The singular forms of "a", "said" and "the" described in the present disclosure and appended claims are also intended to include plural forms, unless the context clearly indicates otherwise.

It should be understood that "first", "second" and similar words used in the specification and claims of the present disclosure do not indicate any order, quantity or importance, but are only used to distinguish different components. Similarly, similar words such as "a" or "an" do not mean a quantity limit, but mean that there is at least one. The term "a plurality of" mentioned in the present disclosure include two or more quantities. Unless otherwise indicated, similar words such as "front", "rear", "lower" and/or "upper" are only for convenience of description, and are not limited to one position or one spatial orientation. Terms such as "including" or "comprising" and other similar words mean that the elements or components before "including" or "comprising" now cover the elements or components listed after "including" or "comprising" and their equivalents, and do not exclude other elements or components.

A heat exchanger of exemplary embodiments of the present disclosure will be described in detail below with reference to the accompanying drawings. In the case of no conflict, the features in the following embodiments and implementation manners may complement each other or be combined with each other.

According to a specific embodiment of the heat exchanger disclosed in the present disclosure, as shown in FIGS. 1 to 9, the heat exchanger includes a first collector 1, a second collector 2 and a heat exchange core 3. One end of the heat exchange core 3 is connected to the first collector 1, and the other end is connected to the second collector 2. An inner chamber of the heat exchange core 3 communicates with an inner chamber of the first collector 1 and an inner chamber of the second collector 2. The first collector 1 is located on one side of the heat exchange core 3 in a length direction, and the second collector 2 is located on the other side of the heat exchange core 3 in the length direction.

In the present embodiment, the heat exchanger is described as a two-process heat exchanger as an example. Specifically, the first collector 1 defines a first chamber 10 and a second chamber 20. The first chamber 10 and the second chamber 20 are not in communication with each other in the first collector 1. The second collector 2 defines a third chamber 30. The heat exchange core 3 includes a plurality of heat exchange tubes. The heat exchange tubes include a plurality of first heat exchange tubes 31 and a plurality of second heat exchange tubes 32. The plurality of first heat exchange tubes 31 are arranged along the length direction of the first collector 1. The plurality of second heat exchange tubes 32 are arranged along the length direction of the first collector 1. A thickness direction of the first heat exchange tube 31 and a thickness direction of the second heat exchange tube 32 are both parallel to or coincide with the length direction of the first collector 1. An inner chamber of each first heat exchange tube 31 is in communication with the first chamber 10 and the third chamber 30. An inner chamber of each second heat exchange tube 32 is in communication with the second chamber 20 and the third chamber 30. Side plates 33 may be provided on the outermost sides of two sides in a thickness direction of the heat exchange core 3 for protecting the heat exchange core 3. A heat exchange element 34 may be provided between two adjacent first heat exchange tubes 31, between two adjacent second heat exchange tubes 32, between the first heat exchange tube 31 and the side plate 33, and between the second heat exchange tube 32 and the side plate 33, for enhancing the heat exchange effect of the heat exchanger and improving the strength of the heat exchanger.

The first collector 1 includes a first piece 11, a second piece 12 and a first sealing member 13. The first sealing member 13 is located between the first piece 11 and the second piece 12. The first sealing member 13 abuts against the first piece 11 and the second piece 12, respectively. The heat exchange core 3 is sealed and connected with the second piece 12. In the present embodiment, the first piece 11 is made of plastic material, the second piece 12 is made of metal, and the first sealing member 13 is made of elastic material. The first piece 11 and the second piece 12 are installed together through a crimping process. The first sealing member 13 is used to form a sealing effect at a junction of the first piece 11 and the second piece 12, thereby forming a relatively sealed space in the first collector 1, and isolating the first chamber 10 and the second chamber 20 from communicating with each other in the first collector 1.

The first piece 11 includes a first groove portion 113, a second groove portion 114 and a spacer portion 115. The spacer portion 115 is located between a groove chamber of the first groove portion 113 and a groove chamber of the second groove portion 114. The spacer portion 115 is not only a part of a sidewall of the first groove portion 113, but also a part of a sidewall of the second groove portion 114. The first chamber 10 is located between a bottom wall of the first groove portion 113 and the second piece 12. The second chamber 20 is located between a bottom wall of the second groove portion 114 and the second piece 12.

Figure 3:
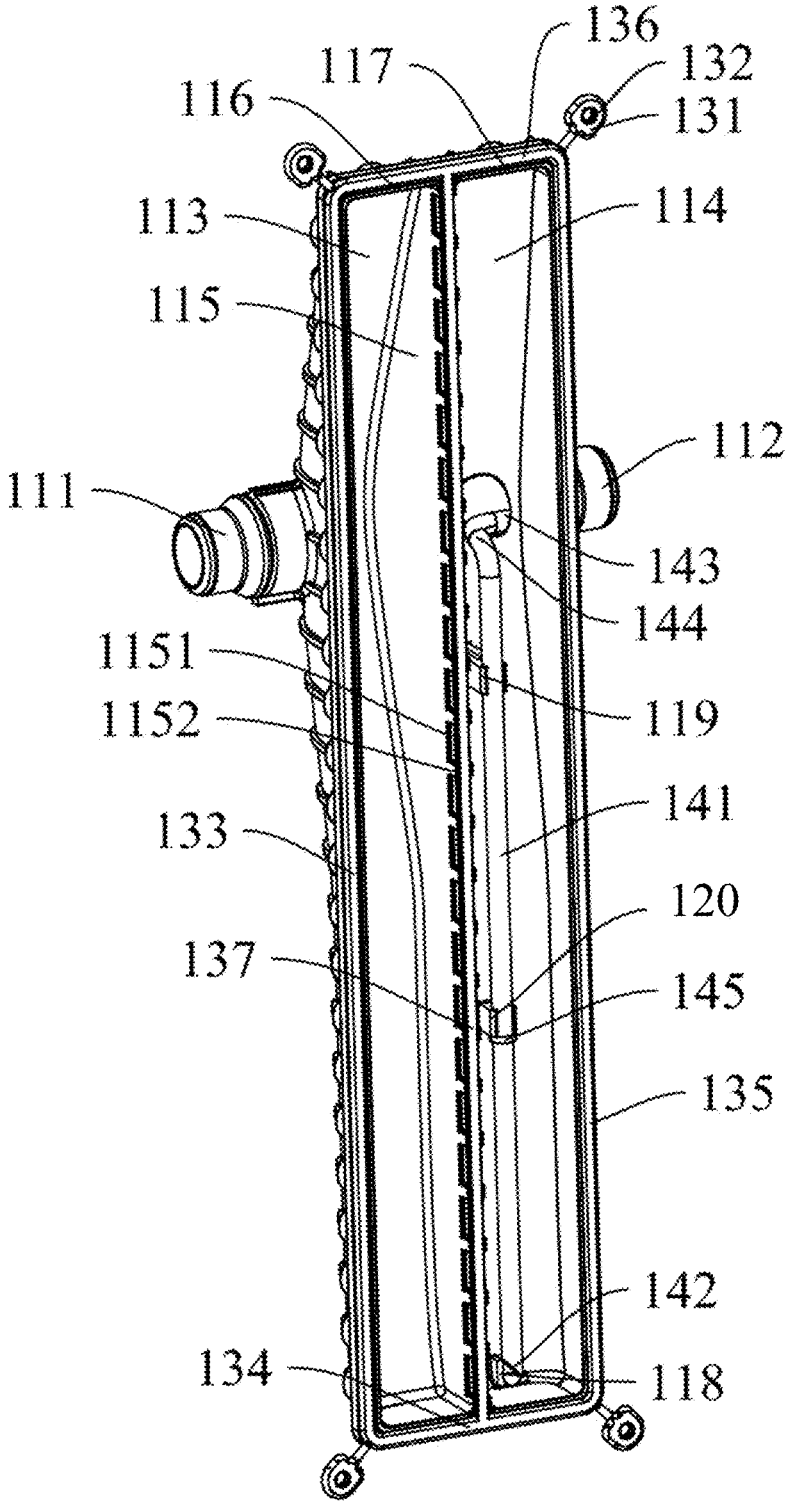
FIG. 3 is a schematic view of an assembled structure of a first piece, a pipe and a first sealing member of the heat exchanger of the present disclosure.
Figure 4:
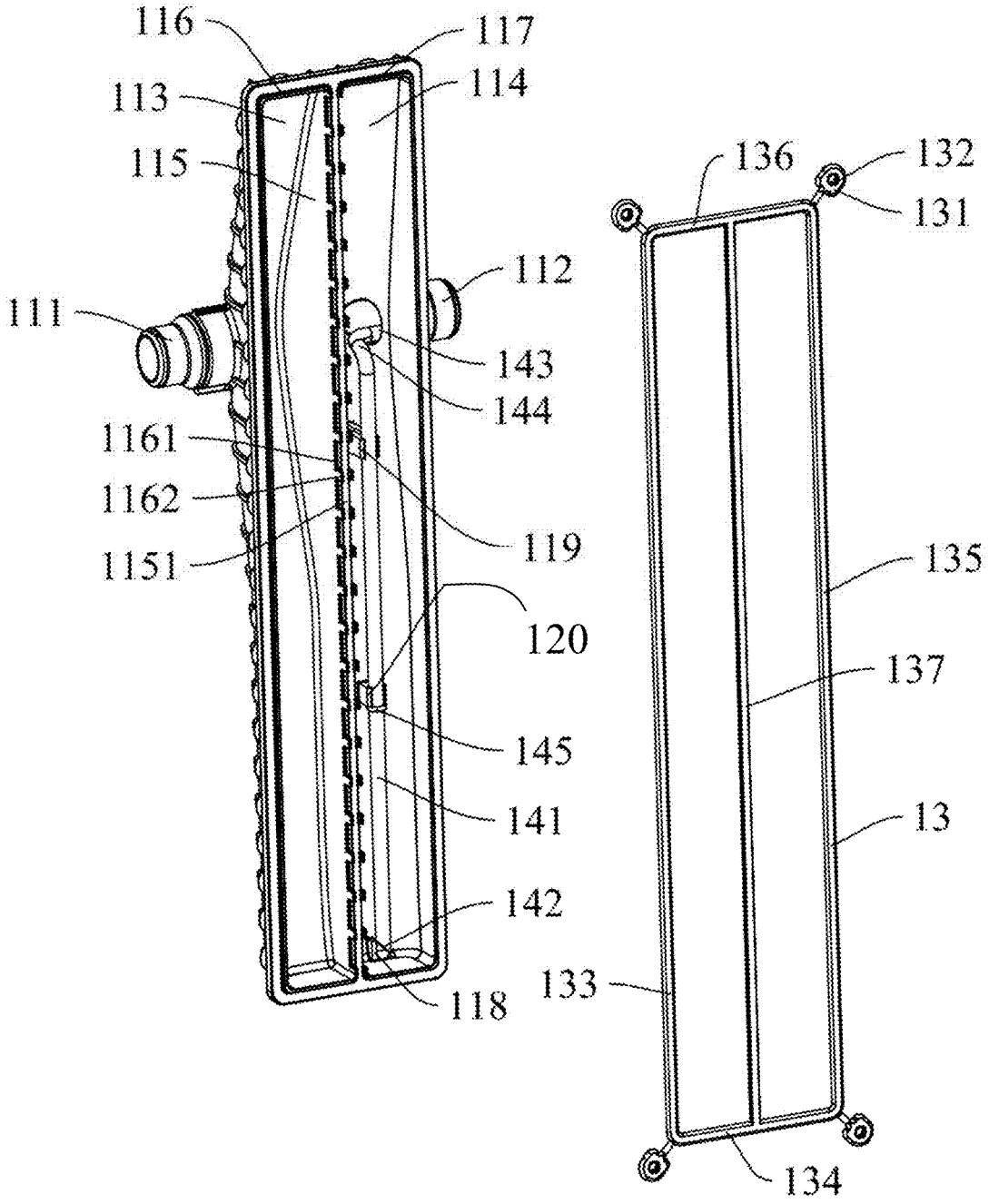
FIG. 4 is a schematic view of the exploded structure shown in FIG. 3.

Referring to FIGS. 3 and 4, the first sealing member 13 includes a second segment 133, a third segment 134, a fourth segment 135, a fifth segment 136 and a first segment 137. In the present embodiment, the second segment 133, the third segment 134, the fourth segment 135, the fifth segment 136 and the first segment 137 are integrally structured. Among which, both the second segment 133 and the fourth segment 135 extend along the length direction of the first collector 1. The second segment 133 and the fourth segment 135 are respectively located on opposite sides of the first collector 1 in a width direction. Both the third segment 134 and the fifth segment 136 extend along the width direction of the first collector 1. The third segment 134 and the fifth segment 136 are respectively located on opposite sides of the first collector 1 in the length direction. The first segment 137 extends along the length direction of the first collector 1. One end of the first segment 137 is connected to a middle area of the third segment 134, and the other end of the first segment 137 is connected to a middle area of the fifth segment 136. The first segment 137 is located between the second segment 133 and the fourth segment 135. The third segment 134 connects one end of the second segment 133 and one end of the fourth segment 135, and the fifth segment 136 connects another end of the second segment 133 and another end of the fourth segment 135. It can be understood that the second segment 133, the third segment 134, the fourth segment 135 and the fifth segment 136 are connected end to end in sequence. The second segment 133, the third segment 134, the fourth segment 135 and the fifth segment 136 together form a substantially square ring structure. The second segment 133, the third segment 134, the fourth segment 135, the fifth segment 136 and the first segment 137 together form a "□" shaped structure.

After the first collector 1 is assembled, the second segment 133, part of the third segment 134, part of the fifth segment 136, and the first segment 137 are arranged around a notch of the first groove portion 113 to prevent a heat exchange medium in the first chamber 10 from flowing out of the heat exchanger through a gap between the first piece 11 and the second piece 12. The fourth segment 135, another part of the third segment 134, another part of the fifth segment 136, and the first segment 137 are arranged around a notch of the second groove portion 114 to prevent a heat exchange medium in the second chamber 20 from flowing out of the heat exchanger through a gap between the first piece 11 and the second piece 12. The spacer portion 115 of the first piece 11 presses against the first segment 137 to form a seal for isolating the first chamber 10 and the second chamber 20.

Positioning structures 131 are provided at a junction of the second segment 133 and the third segment 134, at a junction of the third segment 134 and the fourth segment 135, at a junction of the fourth segment 135 and the fifth segment 136, and at a junction of the second segment 133 and the fifth segment 136. The four positioning structures 131 are respectively located at four corners of the first sealing member 13. Since the first sealing member 13 is made of elastic material, the material is relatively soft and elastic, and it is easy to curl or bend without external force restriction. The positioning structure 131 is used for preliminary positioning of the first sealing member 13 before the assembly of the first piece 11 and the second piece 12. The deformation of the first sealing member 13 causes the first sealing member 13 to deviate, thereby preventing the phenomenon that a good sealing effect cannot be achieved after the installation of the first collector 1 is completed. Optionally, the positioning structure 131 has a positioning hole 132. Preliminary positioning of the first sealing member 13 is achieved by the positioning hole 132 cooperating with a positioning pin on a tooling.

Figure 10:
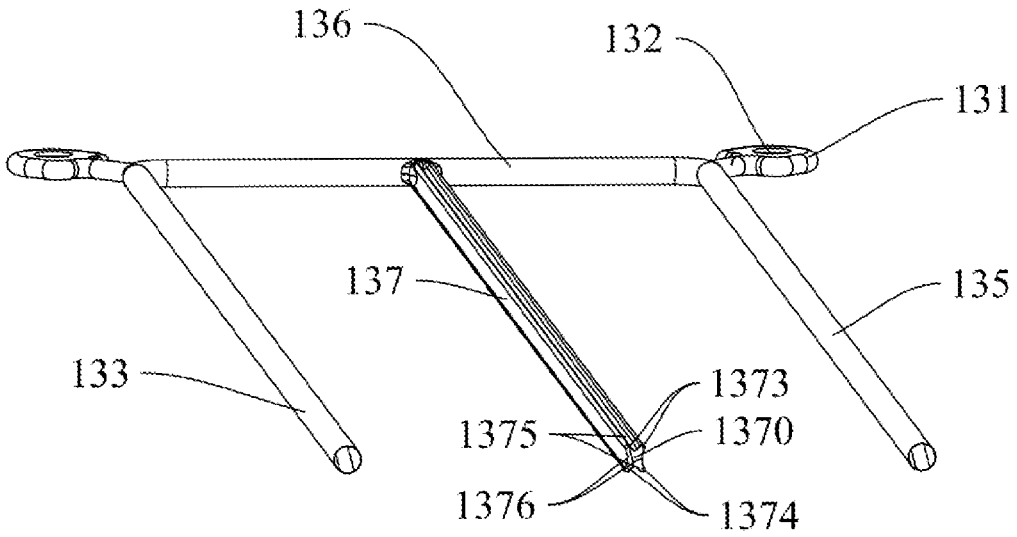
FIG. 10 is a schematic cross-sectional structure view of the first sealing member in a free state in accordance with an embodiment of the present disclosure.
Figure 11:
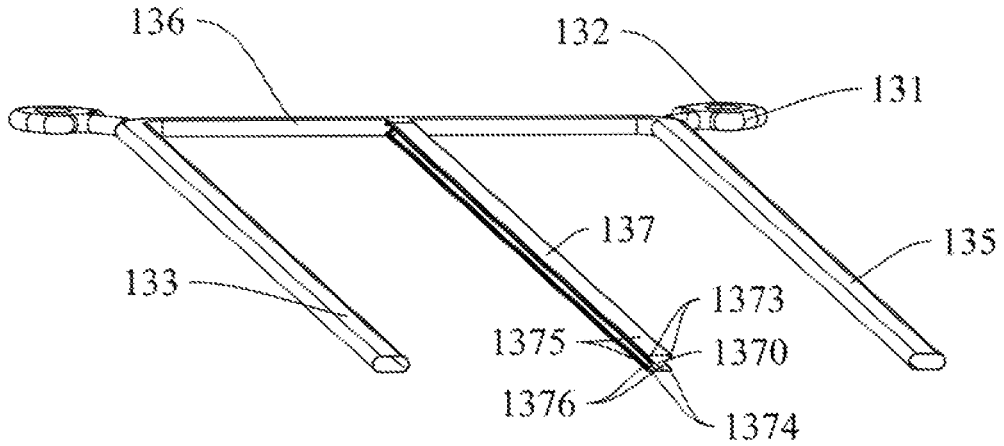
FIG. 11 is a schematic cross-sectional structure view of the first sealing member in a compressed state in accordance with an embodiment of the present disclosure.

The first sealing member 13 is made of elastic material. Optionally, the first sealing member 13 is made of rubber. The first sealing member 13 is pressed by the first piece 11 and the second piece 12 to deform the first sealing member 13 so as to achieve a sealing effect. Referring to FIG. 10 and FIG. 11, cross-sections of the second segment 133, the third segment 134, the fourth segment 135 and the fifth segment 136 are all circular in a free state, and are waist-shaped after being compressed. The second segment 133, the third segment 134, the fourth segment 135 and the fifth segment 136 respectively have surfaces abutting against the first piece 11. The second segment 133, the third segment 134, the fourth segment 135 and the fifth segment 136 respectively have surfaces abutting against the second piece 12. The above-mentioned surfaces are sealing surfaces. The first segment 137 includes a main body portion 1370 and a plurality of convex ribs 1371. The convex ribs 1371 protrude outwardly from the main body portion 1370. The convex rib 1371 extends along the length direction of the first collector 1. A length of the convex rib 1371 is consistent with a length of the first segment 137. When the first segment 137 is in the free state, a concave portion 1372 is formed between each two adjacent convex ribs 1371. A space between two adjacent convex ribs 1371 is an inner chamber of the concave portion 1372. The convex ribs 1371 located on two sides of the concave portion 1372 are sidewalls of the concave portion 1372. A bottom wall of the concave portion 1372 is an outer wall of the main body portion 1370. The plurality of concave portions 1372 include a first concave portion 1375 and a second concave portion 1376. During a sealing process, the convex ribs 1371 located on two sides of the first concave portion 1375 are far away from each other, and the first concave portion 1375 may become straight after the first segment 137 is compressed, or may still be in a curved state. The convex ribs 1371 located on two sides of the second concave portion 1376 are close to each other, and the inner chamber of the second concave portion 1376 becomes smaller after the first segment 137 is compressed. It should be understood that the "free state" in the present disclosure refers to a state where the first sealing member 13 is placed freely without being compressed. The "compressed state" in the present disclosure refers to a state where the first sealing member 13 is compressed by an external force.

Figure 8:
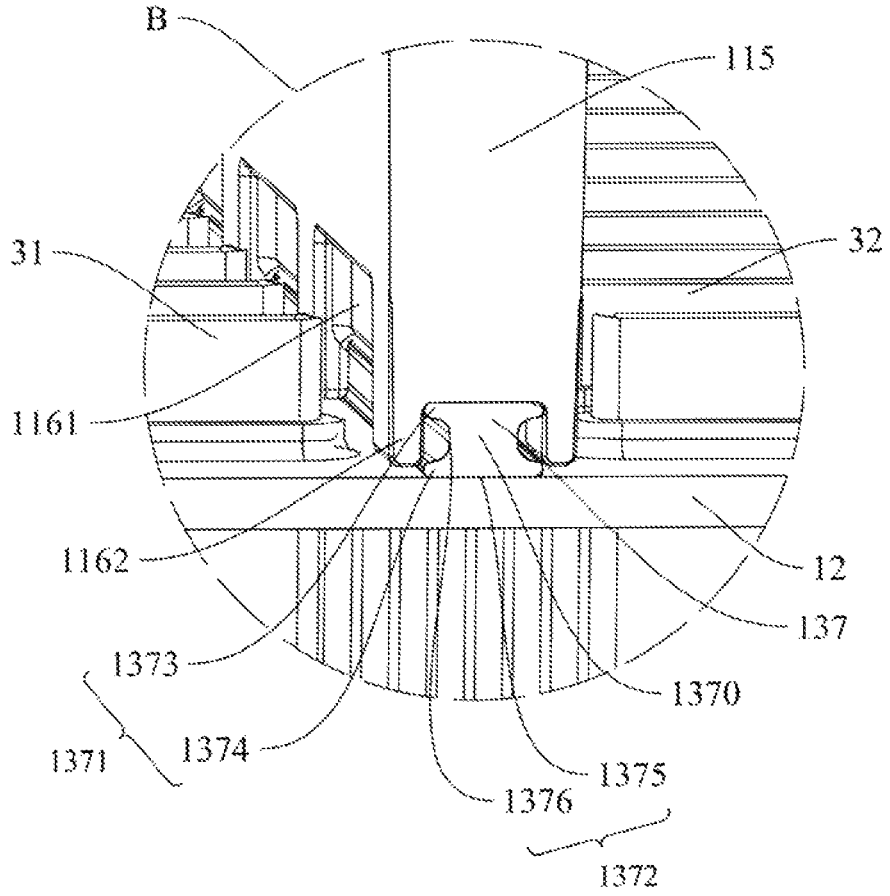
FIG. 8 is an enlarged schematic view of part B in FIG. 7.
Figure 9:
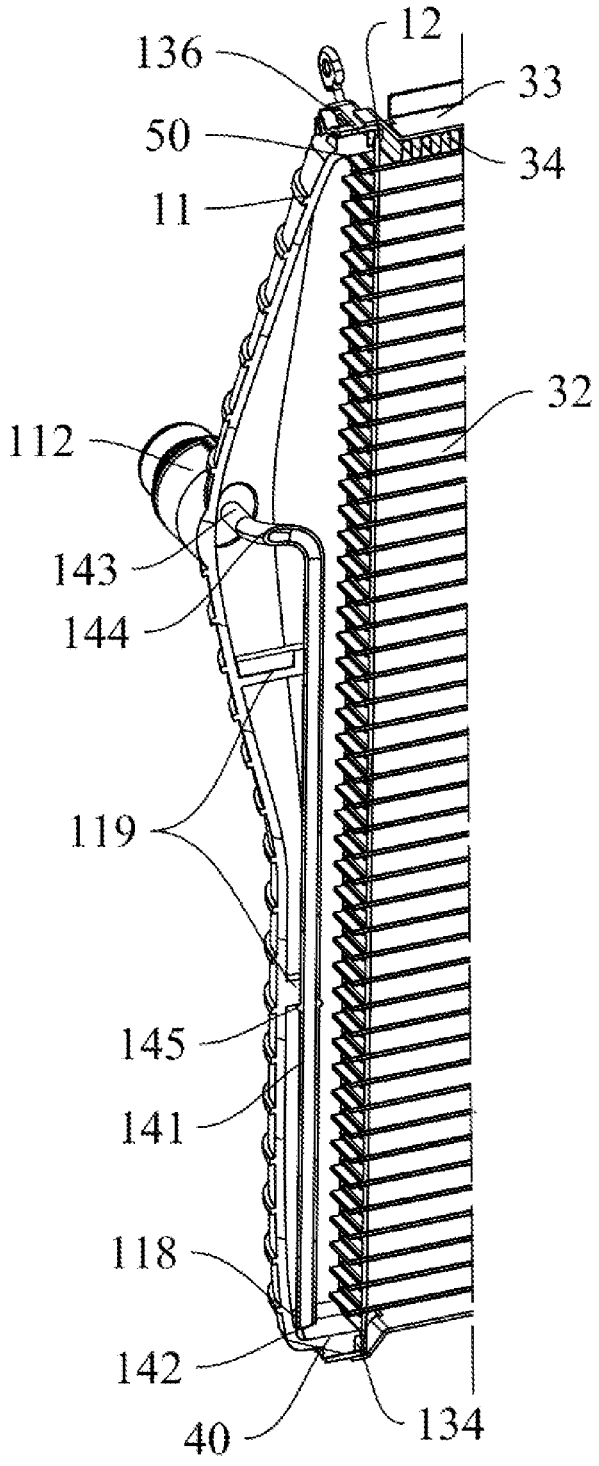
FIG. 9 is a schematic cross-sectional structure view of a partial structure of the heat exchanger.

In some specific embodiments, referring to FIG. 8, FIG. 10 and FIG. 11, the first segment 137 includes four convex ribs 1371 which are arranged around the first segment 137. The four convex ribs include two first convex ribs 1373 and two second convex ribs 1374. After the first segment 137 is compressed, the two first convex ribs 1373 abut against the spacer portion 115, respectively; and the two second convex ribs 1374 abut against the second piece 12, respectively. Correspondingly, the first segment 137 has four concave portions 1372 in the free state. In the present embodiment, when the first segment 137 is in the free state, a cross-section of a bottom wall of the concave portion 1372 is substantially arc-shaped. A cross-section of the first segment 137 in the free state is substantially "X" shaped, and the cross-section of the first segment 137 after being compressed is substantially "I" shaped. Taking a placement direction in FIG. 10 as an example, the first segment 137 includes an upper side facing the first piece 11, a lower side facing the second piece 12, a left side facing the second segment 133 and a right side facing the fourth segment 135. In the free state, openings of the four concave portions 1372 of the first segment 137 face the upper side, the lower side, the left side and the right side, respectively. The four concave portions 1372 include two first concave portions 1375 and two second concave portions 1376. Among which, the concave portions 1372 with the openings facing the upper side and the lower side are the first concave portions 1375, and the concave portions 1372 with the openings facing the left side and the right side are the second concave portions 1376. The two first convex ribs 1373 are respectively located on two sides of one of the first concave portions 1375. The two second convex ribs 1374 are respectively located on two sides of a remaining one of the first concave portions 1375. One side of the second concave portion 1376 are the first convex ribs 1373, and the other side of the second concave portion 1376 are the second convex ribs 1374.

During the assembly process of the first piece 11 and the second piece 12, the two first convex ribs 1373 contact with the spacer portion 115 first. As the first piece 11 and the second piece 12 approach gradually, one of the two first convex ribs 1373 in contact with the spacer portion 115 deviates and deforms to the left, and a remaining one of the two first convex ribs 1373 deviates and deforms to the right. The bottom wall of the first concave portion 1375 which is opened toward an upper side of the first sealing member 13. Depending on the design of the first sealing member 13, after the sealing effect is formed, the bottom wall of the first concave portion 1375 can be completely straightened. That is, the bottom wall of the first concave portion 1375 contacts or presses against the spacer portion 115. At this time, the bottom wall of the first concave portion 1375 is not stressed, or is only subjected to a small force. The bottom wall of the first concave portion 1375 may still have a certain degree of curvature, that is, there is a distance between the bottom wall of the first concave portion 1375 and the spacer portion 115. Likewise, the two second convex ribs 1374 contact the second piece 12 first. As the first piece 11 and the second piece 12 approach gradually, one of the two second ribs 1374 in contact with the second piece 12 deviates and deforms to the left, and a remaining one of the two second ribs 1374 deviates and deforms to the right. The bottom wall of the first concave portion 1375 which is opened to a lower side of the first sealing member 13. Depending on the design of the first sealing member 13, after the sealing effect is formed, the bottom wall of the first concave portion 1375 can be completely straightened. That is, the bottom wall of the first concave portion 1375 contacts or presses against the second piece 12. At this time, the bottom wall of the concave portion 1372 is not stressed, or is only subjected to a small force. The bottom wall of the concave portion 1372 may still have a certain degree of curvature, that is, there is a distance between the bottom wall of the first concave portion 1375 and the second piece 12. Correspondingly, the convex ribs 1371 located on two sides of the second concave portion 1376 whose opening faces to the left are close to each other but not in contact. The convex ribs 1371 located on two sides of the second concave portion 1376 whose opening faces to the right are close to each other but not in contact. It can be understood that, as the first piece 11 and the second piece 12 get closer, the cross section of the first segment 137 gradually changes from "X" to "I", and seals are gradually formed between the first piece 11 and the first sealing member 13 and between the second piece 12 and the first sealing member 13.

After the first piece 11 and the second piece 12 are assembled, the two first convex ribs 1373 abut against the spacer portion 115, respectively, and form the seal. The two second convex ribs 1374 abut against the second piece 12, respectively, and form the seal. That is, the upper side of the first segment 137 has a double-seal structure, and the lower side of the first segment 137 also has a double-seal structure, so as to ensure the reliability of the sealing effect. In the free state, there is the concave portion 1372 between two adjacent convex ribs 1371, which can reduce the resilience force of the first segment 137 after the sealing is completed, thereby protecting the first piece 11 and reducing the possibility of deformation of the first piece 11.

In the related art, in the free states, the cross sections of the second segment 133, the third segment 134, the fourth segment 135, the fifth segment 136 and the first segment 137 are all circular, and the resilience force is relatively large after the seal is formed. A flange of the second piece 12 buckles a peripheral side of the first piece 11, and the second segment 133, the third segment 134, the fourth segment 135 and the fifth segment 136 are distributed on the peripheral side of the first piece 11. The resilience force of the second segment 133, the third segment 134, the fourth segment 135 and the fifth segment 136 interacts with the buckling force of the flange of the second piece 12 to form a better sealing effect. However, since the spacer portion 115 is located in the middle of the first piece 11, the pressing force of the spacer portion 115 on the first segment 137 is relatively small. The large resilience force of the first segment 137 will deform the spacer portion 115 and/or the second piece 12, so that the seal cannot be formed at the first segment 137. In some related technologies, the buckling force of the spacer portion 115 is increased by arranging a bolt structure, a buckle structure, etc., on the spacer portion 115 or the side of the spacer portion 115, so as to improve the deformation phenomenon caused by the resilience force. However, the above method will result in a larger dimension in the width direction of the first collector 1 and a more complicated structure, which is not beneficial to the installation and manufacture of the heat exchanger.

In the present disclosure, the structure of the first segment 137 is improved. The first segment 137 in the free state has the convex rib 1371 and the concave portion 1372, which can reduce the resilience force of the first segment 137 after being compressed, so as to protect the spacer portion 115 and/or the second piece 12. Both the upper side and the lower side of the convex rib 1371 are double-sealed structures, which can ensure the sealing performance of the first sealing member 13 while reducing the resilience force of the first segment 137 after being compressed.

Figure 12:
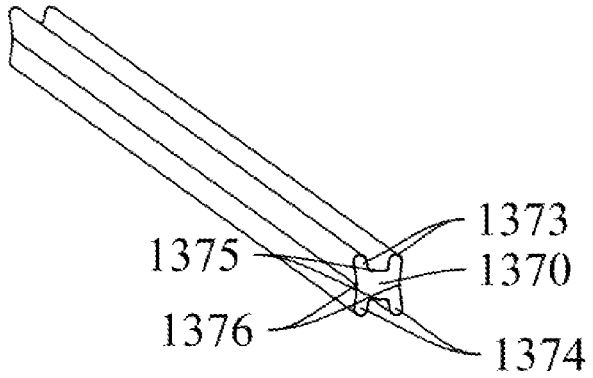
FIG. 12 is a schematic cross-sectional structure view of a first segment in a free state in accordance with another embodiment of the present disclosure.

In some other embodiments, referring to FIG. 12, the first segment 137 includes four convex ribs 1371 which are arranged around a circumference of the first segment 137. The cross-section of the bottom wall of the first concave portion 1375 is substantially linear. The cross section of the first segment 137 in the free state is substantially "H" shaped.

Figure 13:
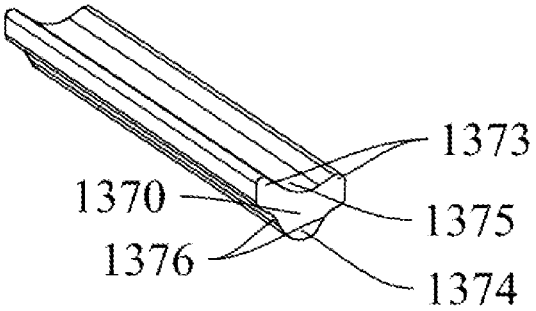
FIG. 13 is a schematic cross-sectional structure view of the first segment in a free state in accordance with yet another embodiment of the present disclosure.

In some other embodiments, referring to FIG. 13, the first segment 137 includes three convex ribs 1371 which are arranged around the circumference of the first segment 137. The three convex ribs 1371 include two first convex ribs 1373 and one second convex rib 1374. The first sealing member 13 is assembled with the first collector 1. But when the first segment 137 is in the free state, the two first convex ribs 1373 protrude toward the spacer portion 115. A first concave portion 1375 is formed between the two first convex ribs 1373. The cross-section of the bottom wall of the first concave portion 1375 may be straight or arc-shaped. The second convex rib 1374 protrudes toward the second piece 12. A second concave portion 1376 is formed between each of the two first convex ribs 1373 and the second convex rib 1374, respectively. The cross-section of the first segment 137 in the free state is substantially "V" shaped. During the sealing process, the two first convex ribs 1373 are far away from each other, and the first convex rib 1373 and the second convex rib 1374 are close to each other. After the first piece 11 and the second piece 12 are assembled, a double sealing structure is formed between the spacer portion 115 and the first segment 137, and a single sealing structure is formed between the first segment 137 and the second piece 12. Further, the second piece 12 may be provided with a groove at a position corresponding to the second convex rib 1374, and the second convex rib 1374 is at least partially located in the groove. The first segment 137 is limited by the groove to ensure the reliability of the installation of the first segment 137, thereby improving the sealing effect at the first segment 137.

In some other embodiments, the first segment 137 may be provided with a larger number of convex ribs 1371. When the first segment 137 is in the free state, a concave portion 1372 is formed between each two adjacent convex ribs 1371. The present disclosure does not limit the number and shape of the convex ribs 1371, as long as the effect of reducing the resilience force of the first segment 137 can be achieved.

In some other embodiments, the first sealing member 13 may further include a plurality of sixth segments. The sixth segment extends along the width direction of the first collector 1. The sixth segment connects the second segment 133 and the first segment 137, or the sixth segment connects the fourth segment 135 and the first segment 137, so as to facilitate the positioning of the first sealing member 13. A cross section of the sixth section in a free state may be the same as the cross section of the first segment 137 or the cross section of the second segment 133.

In some other embodiments, the cross sections of the second segment 133, the third segment 134, the fourth segment 135, and the fifth segment 136 in the free state may be the same as the cross section of the first segment 137, as long as the sealing requirements can be met, which is not limited in the present disclosure.

In some embodiments, the first piece 11 includes an annular protrusion protruding outwardly. The annular protrusion includes a first annular protrusion 116 and a second annular protrusion 117. The first annular protrusion 116 is disposed around the notch of the first groove portion 113. The second annular protrusion 117 is disposed around the notch of the second groove portion 114. Part of the first sealing member 13 is located between the first annular protrusion 116 and the second annular protrusion 117. Part of the first annular protrusion 116 is located between the first sealing member 13 and the first heat exchange tube 31. Part of the second annular protrusion 117 is located between the first sealing member 13 and the second heat exchange tube 32. Specifically, the first segment 137 is located between the first annular protrusion 116 and the second annular protrusion 117. Part of the first annular protrusion 116 is located between the second segment 133 and the first heat exchange tube 31. Part of the first annular protrusion 116 is located between the third segment 134 and the first heat exchange tube 31. Part of the first annular protrusion 116 is located between the fifth segment 136 and the first heat exchange tube 31. Part of the second annular protrusion 117 is located between the third segment 134 and the second heat exchange tube 32. Part of the second annular protrusion 117 is located between the fourth segment 135 and the second heat exchange tube 32. Part of the second annular protrusion 117 is located between the fifth segment 136 and the second heat exchange tube 32.

The second piece 12 includes a first hole portion 121 for inserting the first heat exchange tube 31 and a second hole portion 122 for inserting the second heat exchange tube 32. The first hole portion 121 and the second hole portion 122 may generate burrs during processing. If the first sealing member 13 is in contact with the burrs, it will cause damage to the first sealing member 13, thereby affecting the sealing performance of the first sealing member 13. In the present disclosure, the first annular protrusion 116 and the second annular protrusion 117 are provided to limit the position of the first sealing member 13 and reduce the poor sealing effect caused by the deviation of the first sealing member 13. In addition, the first sealing member 13 can be isolated from the first hole portion 121 and the second hole portion 122 to protect the first sealing member 13, thereby ensuring the sealing effect of the first sealing member 13.

Referring to FIG. 4 and FIG. 8, in some embodiments, part of the first annular protrusion 116 located between the first segment 137 and the first heat exchange tube 31 has a tooth-shaped structure. Specifically, the part of the first annular protrusion 116 includes a plurality of notch portions 1161 and a plurality of extension portions 1162 of which each is located between two adjacent notch portions 1161. The notch portions 1161 and the extension portions 1162 are arranged alternately. An end surface of the notch portion 1161 facing the second piece 12 is closer to the second piece 12 than an end surface of the extension portion 1162 facing the second piece 12. After the first piece 11 and the second piece 12 are assembled, the end surface of the notch portion 1161 facing the second piece 12 and the end surface of the extension portion 1162 facing the second piece 12 are not in contact with the second piece 12. For the same reason, part of the second annular protrusion 117 located between the first segment 137 and the second heat exchange tube 32 has a tooth-shaped structure. The structure of the part of the second annular protrusion 117 is basically the same as the structure of the part of the first annular protrusion 116 located between the first segment 137 and the first heat exchange tube 31, which can be referred to according to the above description. The first segment 137 is limited by the extension portion 1162 of the first annular protrusion 116 and the extension portion 1162 of the second annular protrusion 117, thereby avoiding the problem of poor sealing effect caused by the offset of the first segment 137.

Further, the notch portion 1161 of the first annular protrusion 116 also has a groove recessed in a direction away from the first heat exchange tube 31, and the groove is used to avoid the first heat exchange tube 31 and the first hole portion 121. The notch portion 1161 of the second annular protrusion 117 also has a groove recessed in a direction away from the second heat exchange tube 32, and the groove is used to avoid the second heat exchange tube 32 and the second hole portion 122. The first heat exchange tube 31 and the second heat exchange tube 32 can be made close to each other, thereby reducing the dimension of the heat exchanger in the width direction of the first collector 1, which is beneficial to miniaturization of the heat exchanger.

The first piece 11 includes an inlet pipe 111 and an outlet pipe 112. The inlet pipe 111 is used to guide the heat exchange medium to flow into the heat exchanger. The outlet pipe 112 is used to guide the heat exchange medium to flow out of the heat exchanger. A pipe chamber of the inlet pipe 111 is in communication with the first chamber 10. A pipe chamber of the outlet pipe 112 is in communication with the second chamber 20. The first collector 1 includes a first side 40 and a second side 50. The first side 40 and the second side 50 are located on opposite sides in the length direction of the first collector 1, respectively. Both the inlet pipe 111 and the outlet pipe 112 are located between the first side 40 and the second side 50. The inlet pipe 111 and the outlet pipe 112 are arranged closer to the second side 50. Along a direction from the inlet pipe 111 to the second side 50, and along a direction from the outlet pipe 112 to the second side 50, a thickness of the first collector 1 gradually decreases. With such arrangement, the stagnant water in the first chamber 10 and the second chamber 20 is improved through an inclined surface, and the heat exchange efficiency of the heat exchanger is improved.

The second collector 2 includes a third piece 21, a fourth piece 22 and a second sealing member 23. The second sealing member 23 is located between the third piece 21 and the fourth piece 22. The second sealing member 23 abuts against the third piece 21 and the fourth piece 22, respectively. The heat exchange core 3 is sealed and connected with the fourth piece 22. In the present embodiment, the third piece 21 is made of plastic, the fourth piece 22 is made of metal, and the second sealing member 23 is made of elastic material. The third piece 21 and the fourth piece 22 are installed together through a crimping process. The second sealing member 23 is used to form a sealing effect at a junction of the third piece 21 and the fourth piece 22, so as to form a relatively sealed third chamber 30 in the second collector 2.

Figure 2:
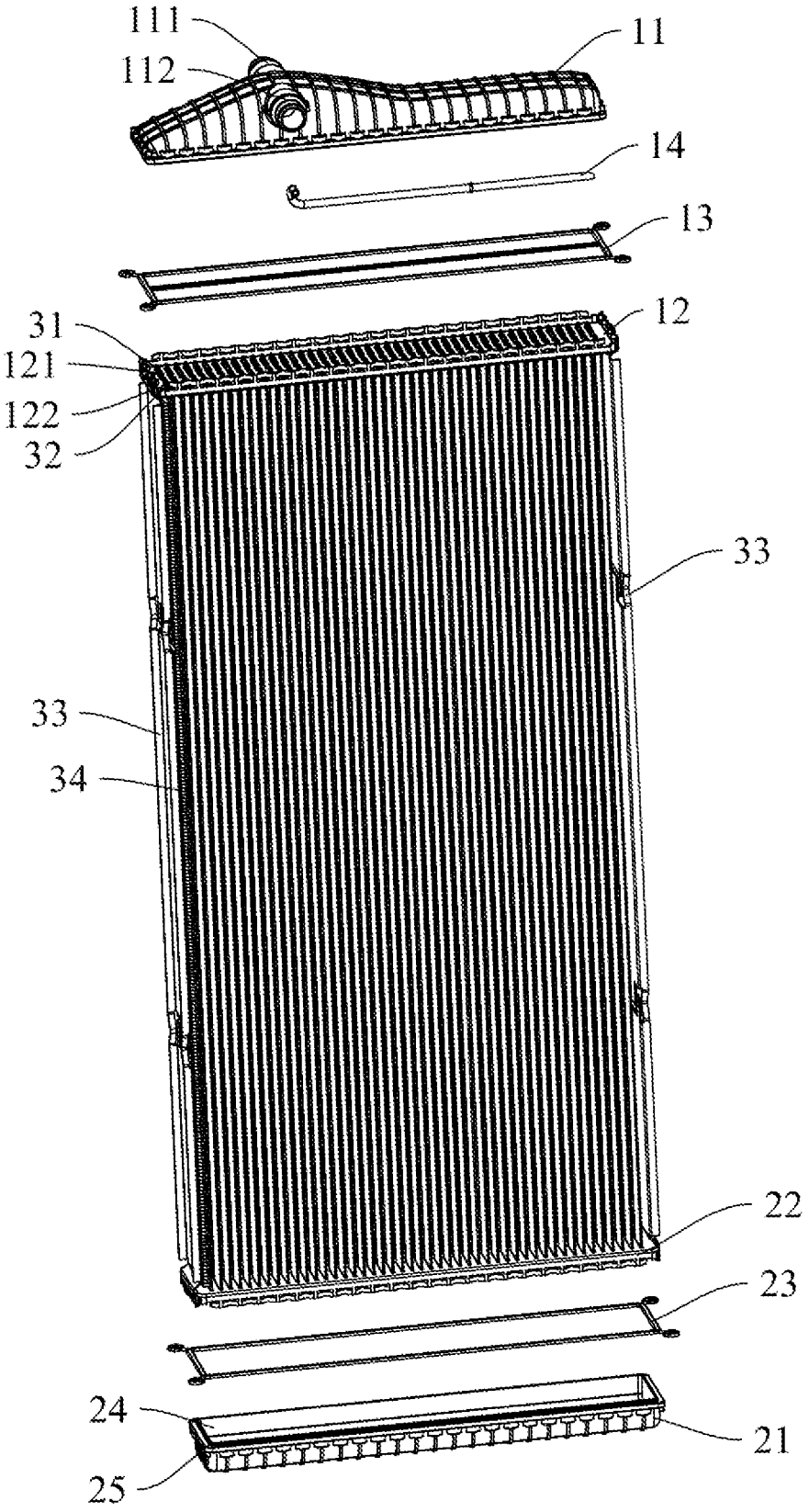
FIG. 2 is a schematic view of an exploded structure of the heat exchanger in accordance with an embodiment of the present disclosure.

Referring to FIG. 2, the second sealing member 23 is substantially in a "mouth" shape. The resilience force of the second sealing member 23 interacts with the buckling force of a flange of the fourth piece 22 to form a better sealing effect. Similarly, four corners of the second sealing member 23 are also provided with positioning structures for forming a preliminary positioning of the second sealing member 23 before the third piece 21 and the fourth piece 22 are assembled.

The third piece 21 includes a third groove portion 24. The third chamber 30 is located between a bottom wall of the third groove portion 24 and the fourth piece 22. In some embodiments, the third piece 21 includes a third annular protrusion 25 which is arranged around a notch of the third groove portion 24. The second sealing member 23 is located between the third annular protrusion 25 and the first heat exchange tube 31. The second sealing member 23 is located between the third annular protrusion 25 and the second heat exchange tube 32. Similarly, the present disclosure provides a third annular protrusion 25, which can limit the position of the second sealing member 23 and reduce the poor sealing effect caused by the deviation of the second sealing member 23. In addition, the second sealing member 23 can be isolated from the hole portion in the fourth piece 22 to protect the second sealing member 23, thereby ensuring the sealing effect of the second sealing member 23.

When the heat exchanger is in working state, the heat exchange medium enters the first chamber 10 from the inlet pipe 111. The heat exchange medium in the first chamber 10 is distributed to the plurality of first heat exchange tubes 31. The heat exchange medium flows along the tube chambers of the first heat exchange tubes 31 and then gathers into the third chamber 30. The heat exchange medium in the third chamber 30 is distributed to the plurality of second heat exchange tubes 32. The heat exchange medium flows along the tube chambers of the second heat exchange tubes 32 and then gathers to the second chamber 20, and finally the heat exchange medium flows out of the heat exchanger through the outlet pipe 112. When the heat exchange medium flows through the first heat exchange tubes 31 and the second heat exchange tubes 32, the heat exchange medium inside the heat exchanger exchanges heat with the heat exchange medium outside the heat exchanger.

Referring to FIGS. 2 to 9, the heat exchanger further includes a pipe 14. Part of the pipe 14 is located in the second chamber 20 and another part of the pipe 14 is located in the pipe chamber of the outlet pipe 112. In the present embodiment, the pipe 14 is made of metal. In other embodiments, the pipe 14 can also be made of plastic, glass or rubber, as long as it can play a drainage role, which is not limited in the present disclosure.

The pipe 14 includes an inlet end portion 142, an outlet end portion 143, a first connection portion 141, and a second connection portion 144. The first connection portion 141 is connected to the second connection portion 144 and the inlet end portion 142. The second connection portion 144 connects the outlet end portion 143 and the first connection portion 141. An inner chamber of the pipe 14 includes an inner chamber of the inlet end portion 142, an inner chamber of the outlet end portion 143, an inner chamber of the first connection portion 141, and an inner chamber of the second connection portion 144. The inlet end portion 142 is arranged close to the first side 40 of the first collector 1. The outlet end portion 143 is located at least partially within the pipe chamber of the outlet pipe 112.

In the present embodiment, an axial extension direction of the inlet pipe 111 and an axial extension direction of the outlet pipe 112 are both parallel to or coincide with the width direction of the first collector 1. The inlet end portion 142 extends along the length direction of the first collector 1. The outlet end portion 143 extends along the width direction of the first collector 1. The first connection portion 141 extends along the length direction of the first collector 1. The inlet end portion 142 and the outlet end portion 143 that are far apart are connected and communicated by the first connection portion 141, and the air distributed close to the first side 40 is guided to the outlet pipe 112 disposed close to the second side 50. The second connection portion 144 includes a portion extending substantially along the length direction of the first collector 1 and another portion extending substantially along the width direction of the first collector 1. Both the portion and the another portion of the second connection portion 144 are arc-shaped, and the flow direction transformation in the pipe 14 is completed through the second connection portion 144. Cross sections of the inlet end portion 142, the outlet end portion 143 and the first connection portion 141 are all circular. The inlet end portion 142, the outlet end portion 143 and the first connection portion 141 are all circular pipes. The length direction of the first collector 1 is defined as a height direction, the inlet pipe 111 and the outlet pipe 112 have a same height, and the inlet end portion 142 and the outlet end portion 143 have different heights.

In some embodiments, a thickness direction of the first collector 1 is defined as the height direction, the inlet end portion 142 and the outlet end portion 143 have different heights; and the inlet end portion 142 and the first connection portion 141 have the same height. The second connection portion 144 further includes a portion extending substantially along the thickness direction of the first collector 1. The second connection portion 144 is used to realize the change of the flow direction of the heat exchange medium in the pipe 14 and adapt to the change of height difference.

Figure 5:
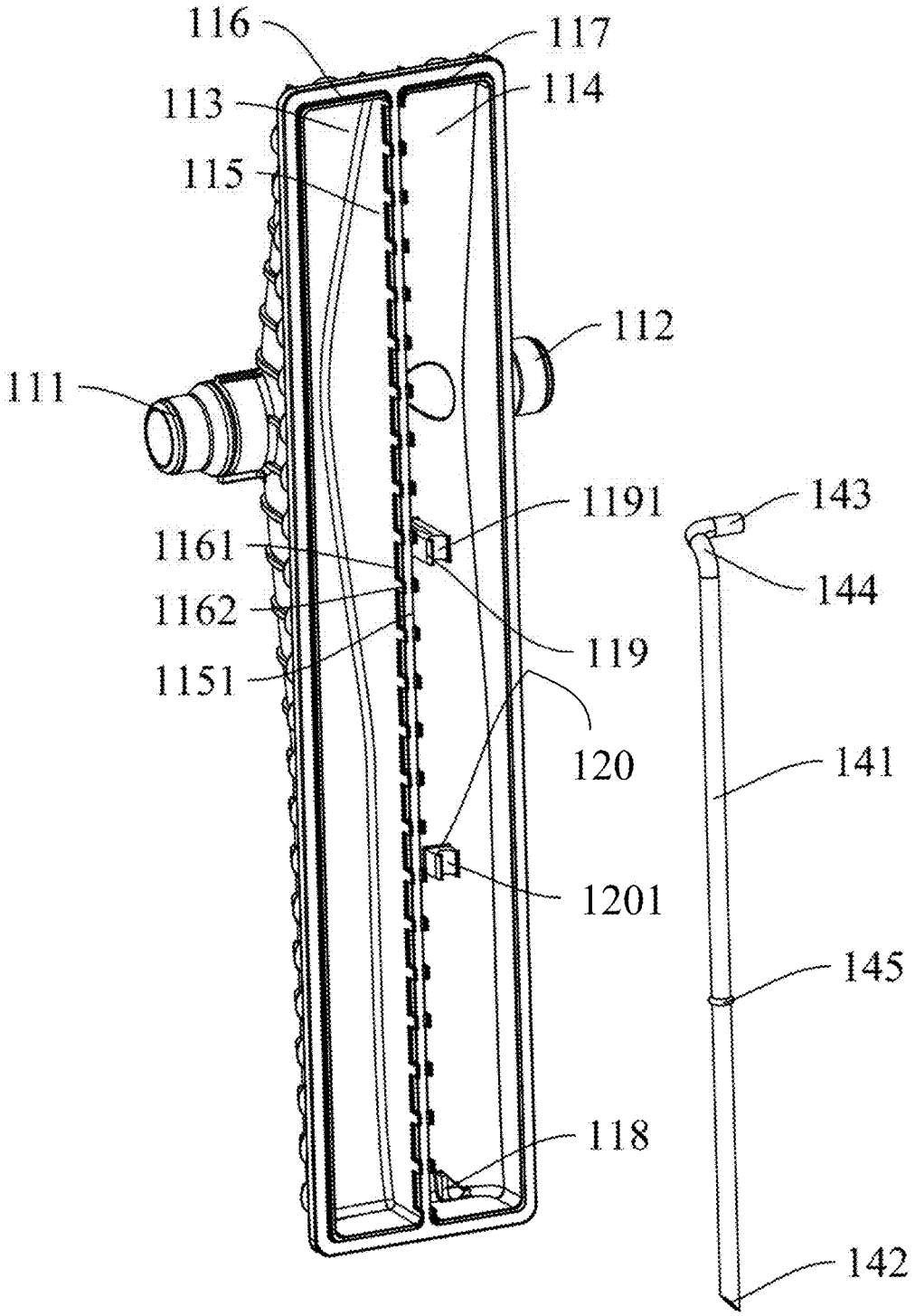
FIG. 5 is a schematic view of the exploded structure of the first piece of the heat exchanger and the pipe of the present disclosure.
Figure 6:
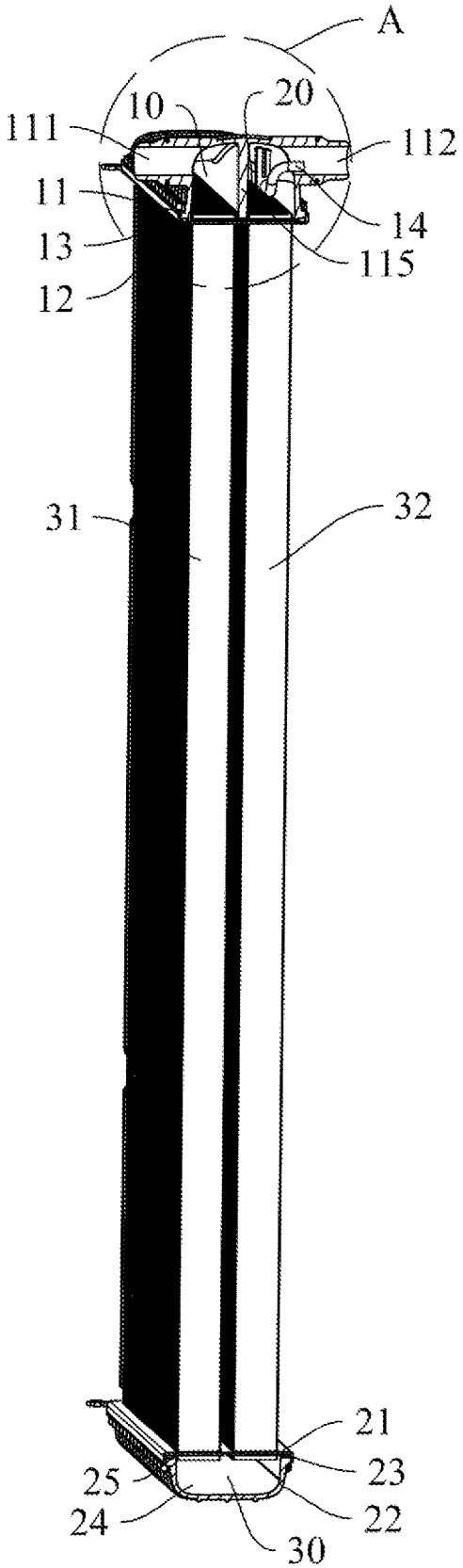
FIG. 6 is a schematic cross-sectional structure view of the heat exchanger in accordance with an embodiment of the present disclosure.
Figure 7:
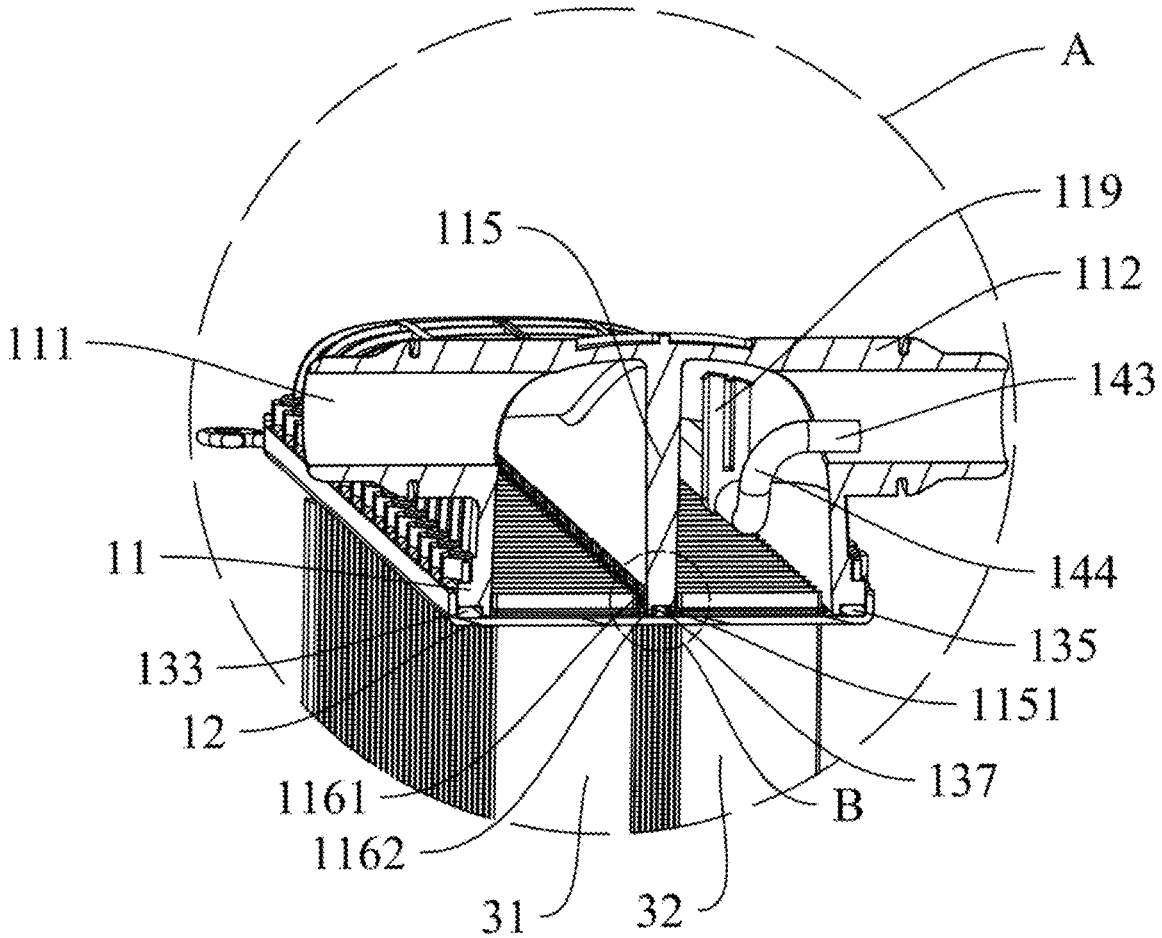
FIG. 7 is an enlarged schematic view of part A shown in FIG. 6.

In some embodiments, referring to FIGS. 3 to 5, a free end of the inlet end portion 142 has an end surface. An axial extension direction of the inlet end portion 142 forms an included angle with the end surface. It can be understood that an inlet of the pipe 14 is obliquely cut, which can increase an inlet area of the pipe 14, facilitate the inflow of air and heat exchange medium, and improve the air discharge efficiency.

Referring to FIGS. 3 to 5, the heat exchanger further includes a first limiting portion 119 and a third limiting portion 120. The first limiting portion 119 and the third limiting portion 120 cooperate with the pipe 14 and are used for installing and limiting the pipe 14 so as to prevent the pipe 14 from falling off and moving. The first limiting portion 119 can be arranged on the first piece 11 or on the second piece 12, as long as it can install and limit the pipe 14, which is not limited in the present disclosure. As shown in FIG. 5, the third limiting portion 120 defines a groove 1201 to mount the pipe 14.

The present embodiment is described by taking the first limiting portion 119 disposed on the first piece 11 as an example. The first limiting portion 119 is integrated with the second groove portion 114. The material of the first limiting portion 119 is the same as that of the first piece 11. The first limiting portion 119 extends from the bottom wall of the second groove portion 114 toward the second member 12. The extension direction of the first limiting portion 119 is parallel to or coincides with the thickness direction of the first collector 1. An end of the first limiting portion 119 away from the bottom wall of the second groove portion 114 has a recess portion 1191. Part of the pipe 14 is located in a groove chamber of the recess portion 1191. The pipe 14 and the recess portion 1191 are mated in an over-radius manner. In other words, in a radial direction of the pipe 14, a portion of the pipe 14 exceeding its radius is received in the recess portion 1191 so as to improve the holding reliability. The shape of the groove chamber of the recess portion 1191 matches an outer shape of the pipe 14. In the present embodiment, a cross section of the pipe 14 is substantially circular, and a bottom wall and two side walls of the recess portion 1191 are also arc-shaped. An outer diameter of the pipe 14 located in the recess portion 1191 is smaller than or equal to a dimension of the recess portion 1191. An outer wall of the pipe 14 is in contact with a groove wall of the recess portion 1191. It can be understood that the two side walls of the recess portion 1191 form two opposite claws. A minimum distance between the two claws is smaller than a maximum dimension of the pipe 14 located in the groove chamber of the recess portion 1191. The recess portion 1191 wraps the pipe 14 so as to limit the displacement of the pipe 14 along the thickness direction of the first collector 1, and prevent the pipe 14 from falling off from the first piece 11. In the thickness direction of the first collector 1, a groove depth of the recess portion 1191 is greater than half of the dimension of the pipe 14 located in the groove chamber of the recess portion 1191.

The number of the first limiting portion 119 is at least one. The first limiting portion 119 cooperates with the first connection portion 141. Referring to FIGS. 3 to 5, the first limiting portion 119 and the third limiting portion 120, are arranged along an axial extension direction of the first connection portion 141. The first connection portion 141 can also be protected to prevent the first connection portion 141 from being bent.

In some other embodiments, when the first limiting portion 119 is located on the second piece 12, the first limiting portion 119 extends from the second piece 12 toward the first piece 11, and the material of the first limiting portion 119 is the same as that of the second member 12. At this time, the structure of the first limiting portion 119 and the way of matching the first limiting portion 119 with the pipe 14 may be the same as the above-mentioned way, or other ways may be adopted. Optionally, the first limiting portion 119 may be made of metal, the pipe 14 is also made of metal, and the pipe 14 is fixedly connected to the first limiting portion 119 by brazing.

The pipe 14 further includes a protrusion 145 which extends from a pipe wall of the pipe 14 in a direction away from the pipe chamber of the pipe 14. The protrusion 145 is disposed on the first connection portion 141, and the protrusion 145 is located outside the groove chamber of the recess portion 1191. The protrusion 145 can be integrated with the pipe wall of the pipe 14, or can be a separate structure and then connected to each other. The protrusion 145 is arranged adjacent to one of the first limiting portions 119. Along the length direction of the first collector 1, the protrusion 145 is farther away from the outlet end portion 143 than the first limiting portion 119 adjacent to the protrusion 145. The protrusion 145 is closer to the inlet end portion 142 than the first limiting portion 119 adjacent to the protrusion 145. On a plane perpendicular to the length direction of the first collector 1, a projection of the protrusion 145 overlaps with a projection of the first limiting portion 119 arranged adjacent to the protrusion 145. In the length direction of the first collector 1, a minimum distance between the protrusion 145 and the outlet end portion 143 is greater than or equal to a minimum distance between the outlet pipe 112 and the protrusion 145. A distance between the protrusion 145 and the outlet end portion 143 is smaller than a maximum distance between the outlet pipe 112 and the protrusion 145. It can be understood that the displacement of the pipe 14 in the length direction of the first collector 1 is restricted by the outlet end portion 143 and the protrusion 145. In the present embodiment, the protrusion 145 is substantially ring-shaped. A maximum distance between two groove walls of the recess portion 1191 is smaller than an outer diameter of the protrusion 145. In some other embodiments, the protrusion 145 may be a plurality of dispersed structures which are distributed along a circumferential direction of the first connection portion 141.

Referring to FIGS. 3 to 5, the heat exchanger further includes a second limiting portion 118. The second limiting portion 118 cooperates with the pipe 14 and is used for limiting the pipe 14 to reduce the falling off of the pipe 14 caused by rotation or swinging. The second limiting portion 118 can be arranged on the first piece 11 or on the second piece 12, as long as it can limit the pipe 14, which is not limited in the present disclosure.

The present embodiment is described by taking the second limiting portion 118 disposed on the first piece 11 as an example. The second limiting portion 118 is integrated with the second groove portion 114. The material of the second limiting portion 118 is the same as that of the first piece 11. The second limiting portion 118 extends from the first piece 11 toward the second piece 12. The second limiting portion 118 is arranged close to the first side 40. The second limiting portion 118 is disposed adjacent to an end of the inlet end portion 142. In the length direction of the first collector 1, the second limiting portion 118 is partially located on a side of the inlet end portion 142 away from the outlet end portion 143. On a plane perpendicular to the length direction of the first collector 1, a projection of the second limiting portion 118 overlaps with a projection of the inlet end portion 142. In the width direction of the first collector 1, the second limiting portion 118 is partially located on a side of the inlet end portion 142 away from the outlet end portion 143. On a plane perpendicular to the width direction of the first collector 1, a projection of the second limiting portion 118 overlaps with a projection of the inlet end portion 142. It can be understood that the second limiting portion 118 is substantially L-shaped. The end of the inlet end portion 142 is located in an L-shaped recessed space, which not only restricts the displacement of the pipe 14 in the length direction of the first collector 1, but also restricts the displacement of the pipe 14 in the width direction of the first collector 1.

In some other embodiments, when the second limiting portion 118 is located on the second piece 12, the second limiting portion 118 extends from the second piece 12 toward the first piece 11. The material of the second limiting portion 118 is the same as that of the second piece 12. Optionally, both the first limiting portion 119 and the second limiting portion 118 may be provided on the first piece 11; or both the first limiting portion 119 and the second limiting portion 118 may be provided on the second piece 12; or one of the first limiting portion 119 and the second limiting portion 118 is provided on the first piece 11, and a remaining one of the first limiting portion 119 and the second limiting portion 118 is provided on the second piece 12.

The first limiting portion 119 and the pipe 14 are fit in an over-radius manner to limit the displacement of the pipe 14 along the thickness direction and the width direction of the first collector 1. The protrusion 145 cooperates with the first limiting portion 119, the inlet end portion 142 cooperates with the second limiting portion 118, and the outlet end portion 143 cooperates with the outlet pipe 112, so as to limit the displacement of the pipe 14 along the length direction of the first collector 1. The pipe 14 itself is substantially L-shaped. The outlet end portion 143 of the pipe 14 is located at least partially within the pipe chamber of the outlet pipe 112. Due to the limitation of the diameter of the outlet pipe 112, the rotatable angle of the outlet end portion 143 is relatively small. Further, the first connection portion 141 is limited by the first limiting portion 119, and the inlet end portion 142 is limited by the second limiting portion 118, thereby limiting the multi-directional rotation of the pipe 14. Specifically, when the outlet end portion 143 of the pipe 14 rotates around an axis parallel to the length direction of the first collector 1, the first connection portion 141 also rotates around another axis parallel to the length direction of the first collector 1. The pipe 14 is limited by the action of the first limiting portion 119. When the outlet end portion 143 of the pipe 14 rotates around an axis parallel to the thickness direction of the first collector 1, the first connection portion 141 also rotates around another axis parallel to the thickness direction of the first collector 1. The inlet end portion 142 swings on a plane perpendicular to the thickness direction of the first collector 1. The pipe 14 is limited by the restriction of the outlet pipe 112 and the restriction of the second limiting portion 118. When the outlet end portion 143 of the pipe 14 rotates around an axis parallel to the width direction of the first collector 1, the first connection portion 141 also rotates around another axis parallel to the width direction of the first collector 1. The inlet end portion 142 approaches or moves away from the bottom wall of the second groove portion 114. Due to the limitation of the second groove portion 114 and the limitation of the first limiting portion 119, the pipe 14 is limited. In summary, regardless of the rotation and displacement of the outlet end portion 143 in any direction, through the actions of the first limiting portion 119, the second limiting portion 118, the outlet pipe 112, the protrusion 145 and the second groove portion 114, the pipe 14 can be limited, thereby improving the reliability of the installation and positioning of the pipe 14.

In practical applications, the first side 40 is farther away from the ground than the second side 50. It can be understood that the first collector 1 is arranged obliquely or perpendicularly to the ground. Due to the force of gravity and the flow of the heat exchange medium, air will accumulate in an area of the second chamber 20 close to the first side 40. The present disclosure is provided with the pipe 14. The inlet end portion 142 of the pipe 14 is located in the second chamber 20 and is disposed close to the first side 40. The outlet end portion 143 of the pipe 14 is located at least partially in the pipe chamber of the outlet pipe 112. Air enters the pipe 14 from the inlet end portion 142 and flows along the inner chamber of the pipe 14. The air is expelled from the outlet end portion 143 into the outlet pipe 112. The air flows out of the heat exchanger along with the heat exchange medium, and the pipe 14 is used to guide the air to the outlet pipe 112 to be discharged out of the heat exchanger together with the heat exchange medium. Compared with the prior art, the collector assembly including the pipe 14 and the first collector 1 in the present disclosure cancels the opening on the first collector 1 for installing the air discharge pipe, thereby simplifying the structure of the first collector 1. The present disclosure cancels the pipeline connected to the air discharge pipe, thereby reducing the leakage points of the first collector 1 and reducing the manufacturing cost of the heat exchange system. When discharging the air, the pipe 14 is used as an air discharge pipe. After the air is discharged, the heat exchange medium flows in the pipe 14, which will not cause the heat exchange medium to diverge, and has limited impact on the heat exchange effect of the heat exchanger.

In some other embodiments, the heat exchanger is a single-process heat exchanger. Specifically, the first collector 1 has only one first chamber, and the second collector 2 has only one second chamber. The heat exchange core 3 includes a plurality of third heat exchange tubes which are arranged along the length direction of the first collector 1. A thickness direction of the third heat exchange tube is parallel to or coincides with the length direction of the first collector 1. An inner chamber of each third heat exchange tube is in communication with the first chamber and the second chamber. The first collector 1 includes an inlet pipe 111. The second collector 2 includes an outlet pipe 112. A pipe chamber of the inlet pipe 111 is in communication with the first chamber, and a pipe chamber of the outlet pipe 112 is in communication with the second chamber. The pipe 14 is mated with the second collector 2. The pipe 14 is located inside the second collector 2. When the heat exchanger is in working state, the heat exchange medium enters the first chamber from the inlet pipe 111. The heat exchange medium in the first chamber is distributed to the plurality of third heat exchange tubes. The heat exchange medium flows along tube chambers of the third heat exchange tubes, and then gathers into the second chamber. Finally, the heat exchange medium flows out of the heat exchanger from the outlet pipe 112. When the heat exchange medium flows through the third heat exchange tubes, the heat exchange medium inside the heat exchanger exchanges heat with the heat exchange medium outside the heat exchanger.

In some other embodiments, the heat exchanger is a multiple-process heat exchanger. Specifically, the first collector 1 includes a plurality of chambers in the first collector 1 that are not in direct communication with one another. The second collector 2 includes a plurality of chambers in the second collector 2 that are not in direct communication with one another. The heat exchange core 3 includes a plurality of heat exchange tubes which are divided into multiple portions. Each portion of the heat exchange tubes is in communication with one chamber of the first collector 1 and one chamber of the second collector 2 so as to form the multiple-process heat exchanger. The pipe 14 is located in a chamber communicating with the outlet pipe 112. Depending on the design of the heat exchanger, the chamber can be located in the first collector 1 or in the second collector 2. The first sealing member 13 includes a plurality of seventh segments whose design principle is the same as that of the first segment 137. The seventh segments are located between two adjacent chambers of the first collector 1, and also located between two adjacent chambers of the second collector 2.

The above descriptions are only preferred embodiments of the present disclosure, and are not intended to limit the present disclosure in any form. Although the disclosure has been disclosed above with preferred embodiments, it is not intended to limit the present disclosure. Any skilled in the art may use the technical contents disclosed above to make some changes or modify them into equivalent embodiments without departing from the scope of the technical solutions disclosed in the present disclosure. However, any simple modifications, equivalent changes and modifications made to the above embodiments based on the technical essence of the present disclosure are still within the scope of the technical solution of the present disclosure.

What is claimed is:

1. A heat exchanger, comprising:

a first collector defining a first chamber and a second chamber;

wherein the first collector comprises a first piece, a second piece and a first sealing member; the first piece is fixed to the second piece; the first piece comprises a spacer portion between the first chamber and the second chamber; the first sealing member comprises a first segment which is located between the spacer portion and the second piece; both the spacer portion and the second piece abut against the first segment;

wherein the first segment comprises a main body portion, a concave portion and at least two convex ribs; the convex ribs protrude from the main body portion in a direction away from the main body portion; an inner chamber of the concave portion is located between two adjacent convex ribs; and the spacer portion or the second piece abuts against the convex ribs;

wherein the spacer portion abuts against two convex ribs of the plurality of convex ribs;

when the first segment is in a free state, the concave portion comprises a first concave portion, the first concave portion is located between the two convex ribs which abut against the spacer portion;

when the first segment is in a compressed state, a bottom wall of the first concave portion contacts, presses against, or has a gap with the spacer portion;

wherein the first sealing member comprises a second segment, a third segment, a fourth segment and a fifth segment; the third segment connects one end of the second segment and one end of the fourth segment; the fifth segment connects another end of the second segment and another end of the fourth segment; the first segment connects the third segment and the fifth segment; the first segment is located between the second segment and the fourth segment; the first segment is spaced apart from the second segment and the fourth segment respectively by a certain distance; and the second segment, the third segment, the fourth segment and the fifth segment are located between the first piece and the second piece; the first piece and the second piece abut against the second segment, respectively; the first piece and the second piece abut against the third segment, respectively; the first piece and the second piece abut against the fourth segment, respectively; and the first piece and the second piece abut against the fifth segment, respectively;

wherein the first piece comprises a first groove portion and a second groove portion; the first chamber is located between the first groove portion and the second piece; and the second chamber is located between the second groove portion and the second piece;

wherein the first piece comprises an annular protrusion, and the heat exchanger comprises a heat exchange tube; and wherein the annular protrusion is arranged around the notch of the first groove portion, and a tube chamber of the heat exchange tube communicates with the first chamber;

wherein the annular protrusion comprises a plurality of notch portions and an extension portion located between two adjacent notch portions; an end surface of the notch portion facing a side of the second piece is closer to the second piece than an end surface of the extension portion facing a side of the second piece; the end surface of the notch portion facing the side of the second piece and the end surface of the extension portion facing the side of the second piece are both are separated from the second piece by a certain distance; and the notch portion comprises a groove recessed in a direction away from the heat exchange tube.

2. The heat exchanger according to claim 1, wherein the first sealing member comprises a plurality of positioning structures located at a junction of the second segment and the third segment, at a junction of the third segment and the fourth segment; at a junction of the fourth segment and the fifth segment, and at a junction of the fifth segment and the second segment; and the positioning structures are located outside the first piece, and the positioning structures are located outside the second piece.

3. The heat exchanger according to claim 1, wherein the second piece abuts against another two of the plurality of convex ribs.

4. The heat exchanger according to claim 3, wherein when the first segment is in the free state, the concave portion comprises a second concave portion, the first concave portion is located between the two convex ribs which abut against the second portion; the second concave portion is located between the convex rib abutting against the spacer portion and the convex rib abutting against the second piece; an opening of the second concave portion faces the first chamber and the second chamber;

wherein a bottom wall of the first concave portion is arc-shaped, and a cross section of the first segment in the free state is substantially "X" shaped.

5. The heat exchanger according to claim 1, wherein cross-sections of the second segment, the third segment, the fourth segment and the fifth segment in free states are the same as a cross-section of the first segment in a free state.

* * * * *